US005495624A

United States Patent [19]

Lisook et al.

[11] Patent Number: 5,495,624

[45] Date of Patent: Mar. 5, 1996

[54] TOILET BOWL WATER CONSERVATION UNIT

[76] Inventors: Ira M. Lisook, 42 Marilyn Rd., Milton, Mass. 02186; Edward Lombardi, 48 Lawrence Rd., Derry, N.H. 03038

[21] Appl. No.: 286,549

[22] Filed: Aug. 5, 1994

[51] Int. Cl.[6] ..... E03D 1/12

[52] U.S. Cl. ..... 4/325; 4/363

[58] Field of Search ..... 4/144.1, 300.2, 4/301, 325, 326, 340, 341, 342, 345, 346, 363, 364, 420.4, 415, 448, 223, 226.1, 308, 310, 311, 420.5, 665, 324

[56] References Cited

U.S. PATENT DOCUMENTS

| | | | |
|---|---|---|---|
| 452,962 | 5/1891 | Beekman | 4/364 X |
| 1,805,204 | 5/1931 | Brown | 4/326 |
| 2,049,534 | 8/1936 | Byerlein | 4/341 X |
| 3,336,602 | 8/1967 | Kubit | 4/301 X |
| 3,344,439 | 10/1967 | Davies | 4/326 |
| 3,810,260 | 5/1974 | Lodi | 4/420.4 |
| 3,946,447 | 3/1976 | Moon | 4/363 X |
| 3,947,900 | 4/1976 | Duke | 4/324 X |
| 3,984,878 | 10/1976 | Grasseschi | 4/324 |
| 4,075,718 | 2/1978 | Hargraves | 4/345 X |
| 4,152,793 | 5/1979 | Mills | 4/325 |
| 4,180,875 | 1/1980 | Wilson | 4/311 X |
| 4,183,108 | 1/1980 | Hamilton | 4/354 |
| 4,561,131 | 12/1985 | David | 4/326 |
| 5,067,180 | 11/1991 | Figeroid | 4/326 |
| 5,090,067 | 2/1992 | Cogdill | 4/420.4 X |
| 5,101,520 | 4/1992 | Lockhart | 4/420.4 X |
| 5,272,774 | 12/1993 | Ivko et al. | 4/420.4 X |

FOREIGN PATENT DOCUMENTS

| | | | |
|---|---|---|---|
| 0268576 | 12/1913 | Germany | 4/665 |
| 2347505 | 4/1975 | Germany | 4/326 |
| 4124334 | 4/1992 | Japan | 4/364 |
| 0003912 | of 1906 | United Kingdom | 4/665 |

*Primary Examiner*—Robert M. Fetsuga
*Attorney, Agent, or Firm*—Morgan & Finnegan

[57] ABSTRACT

An apparatus and a method for conserving the volume of water consumed during the flushing of waste deposited in the bowl of a toilet. A secondary water reservoir is mounted externally on the primary water reservoir of a conventional toilet. The primary water reservoir holds a first body of water whose volume is greater than a second body of water held by the secondary water reservoir. The first body of water may be discharged from the primary water reservoir directly into the bowl. Alternatively, the second body of water may be discharged from said second water reservoir into a water feed member which is mounted externally on the rim of the bowl and which directs said second body of water into said bowl along its perimeter in a slight downwardly direction.

26 Claims, 3 Drawing Sheets

TOILET BOWL WATER CONSERVATION UNIT

BACKGROUND OF INVENTION

1. Field of the Invention

The present invention relates generally to toilets and, more particularly, to devices which may be used in conjunction with toilets for the purpose of conserving the volume of water consumed during the flushing of waste from a toilet.

2. Description of Related Art

Most toilets today comprise a reservoir for storing a body of water and a bowl into which solid and liquid waste material is deposited. To dispose of the waste material, the entire body of water stored in the reservoir is released into the bowl thereby flushing and discharging the waste from the bowl into a septic or sewer system.

The volume of water necessary to flush and discharge waste material from the bowl is often less than the volume of water stored in the reservoir. For example, less water is required to flush and discharge a small quantity of solid waste material or liquid waste than is required for a larger quantity of solid waste.

On the typical toilet, however, the volume of water consumed during each flushing process is generally not adjustable without physically adjusting a float mechanism, or other similar valve control, controlling the volume of water permitted to enter the toilet reservoir. This method of adjusting the water volume is impractical and inconvenient where frequent adjustment is required, such as where the quantity of waste material sought to be discharged from the bowl is relatively small or where the waste material is in liquid form.

Accordingly, much water is wasted since the reservoir volume is the same whether flushing a large quantity of solid waste material or a smaller quantity of liquid waste. Others have attempted to design devices for conserving the amount of water consumed during each flushing process. The majority of these devices, however, are not readily installable by the average consumer, are designed to be installed within the existing toilet reservoir and do not offer selectively alternative flushing volumes dependent upon the volume of water required to effectively flush the toilet bowl.

SUMMARY OF INVENTION

The present invention contemplates an apparatus for modifying an existing conventional toilet to allow the user to select alternative volumes of water for flushing waste deposited in the toilet bowl. The present invention generally comprises a secondary water reservoir which is mounted externally to the existing primary reservoir of the toilet, a water feed member mounted on the existing bowl rim of the toilet, discharge means for connecting said secondary reservoir to said water feed member, and inlet means for introducing water into said secondary reservoir.

It is a principle object of the present invention to conserve the amount of water used in the flushing and discharge of waste from a toilet or similar apparatus.

Another object of this invention is to control the volume of water used in flushing waste from a toilet based upon the quantity and type of waste being disposed of.

Another object of this invention is to inexpensively modify a toilet or similar apparatus to alternatively permit the user thereof to select a larger or lesser volume of water for flushing waste from the toilet depending upon the quantity and type of waste being disposed of.

It is yet another object of this invention to inexpensively adapt a conventional toilet or other apparatus for use with the present invention without interfering with the normal operation of the conventional toilet.

Another object of the present invention is to permit an unskilled homeowner, as well as a professional plumber, to install the present invention on a conventional toilet.

These objectives, together with other objects and advantages which will become subsequently apparent, reside in the details of construction and operation as more fully hereafter described in the following portions of the specification and attached drawings, wherein the detailed description is for the purpose of fully disclosing a preferred embodiment of the invention without placing limitations thereon.

BRIEF DESCRIPTION OF THE DRAWINGS

The present invention will be more fully understood by reference to the following drawings which are for illustration purposes only.

DETAILED DESCRIPTION OF THE INVENTION

Figure 1:
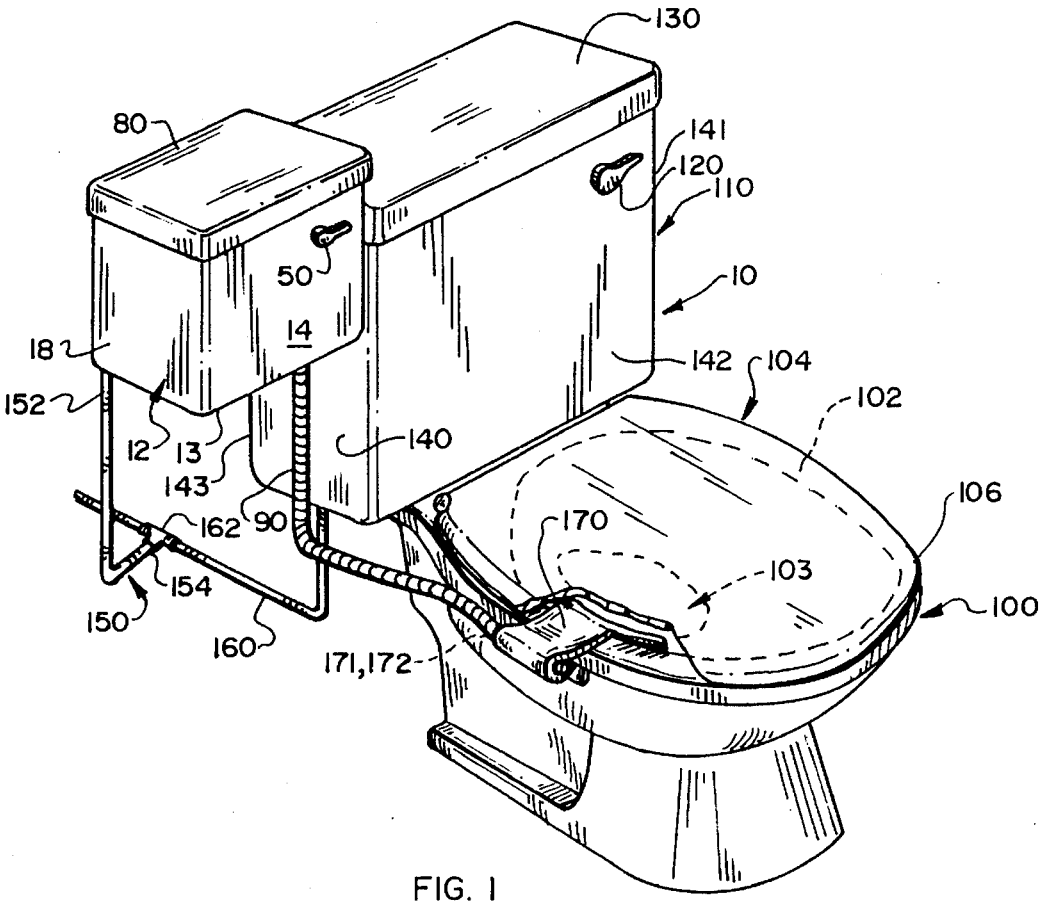
FIG. 1 shows an overall perspective view of a preferred embodiment of the apparatus mounted on a conventional toilet.
Figure 2:
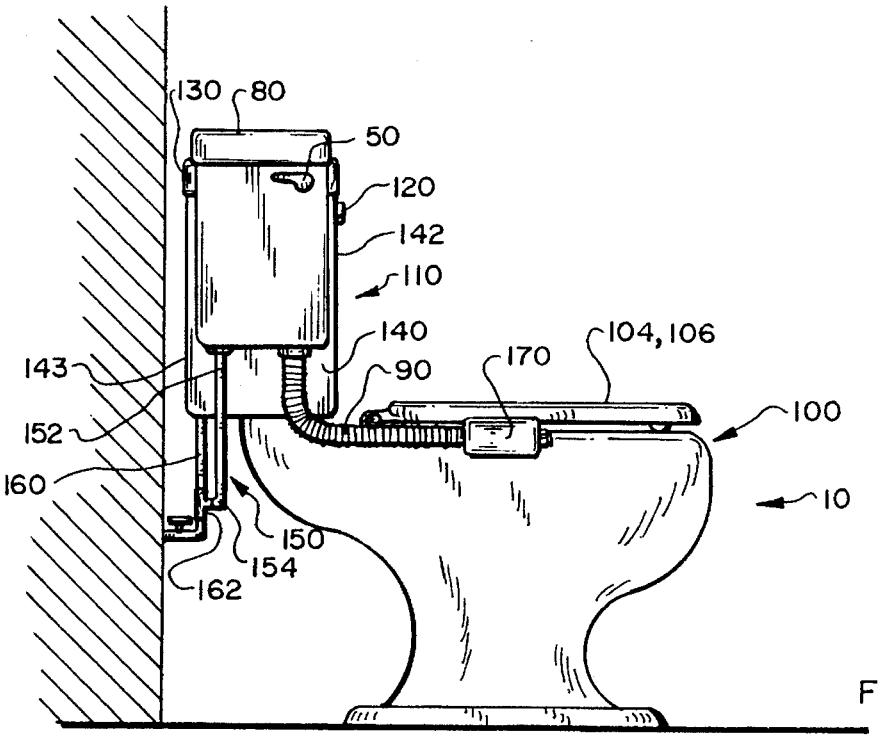
FIG. 2 is side elevation view of the apparatus and toilet shown in FIG. 1.

Referring more specifically to the drawings, the present invention is embodied in the apparatus generally shown in FIGS. 1 and 2. It is understood that the apparatus may vary as to configuration and as to details of parts without departing from the basic concepts as disclosed herein.

Referring to FIGS. 1 and 2, a preferred embodiment of the present invention is shown to be mounted on a conventional toilet 10. As is commonly known, conventional toilet 10 includes a primary water reservoir 110 holding a first body of water and containing conventional flushing means which is not shown but is generally well known, a primary flush handle 120, a primary water reservoir cover 130, a toilet bowl 100 having a rim 102 and a drain 103, a toilet bowl seat 106 and a toilet bowl lid 104.

Generally, waste material that is deposited in the bowl 100 can be discharged into a septic or sewer system by pushing primary flush handle 120 in a generally downward direction causing the flushing means to discharge the first body of water contained within primary reservoir 110 into bowl 100, the first body of water thereby carrying the waste material out of the bowl 100 through drain 103. Following the flushing process, fresh water is thereafter automatically restored into the primary water reservoir 110 through primary reservoir inlet tube 160, which is controlled by a conventional valve assembly and float not shown in the figures.

The preferred embodiment of the present invention is secured to the exterior of conventional toilet 10 so as to not interfere with the above-mentioned operation of the toilet 10. Referring to FIGS. 3–6, a secondary water reservoir 12, preferably made of plastic, is utilized with conventional toilet 10 for holding a second body of water. Preferably, the secondary water reservoir 12 is generally rectangular having two side walls 18 and 19, a front wall 14, and a rear wall 16, each of which are connected to and extending from a bottom panel or plate 13. The volume of secondary water reservoir 12 is preferably less than that of primary water reservoir 110. While the rectangular shape is for convenience, the shape of the secondary water reservoir 12 could be square, cylindrical, or other shape without departing from the basic concept of the invention.

Figure 4:
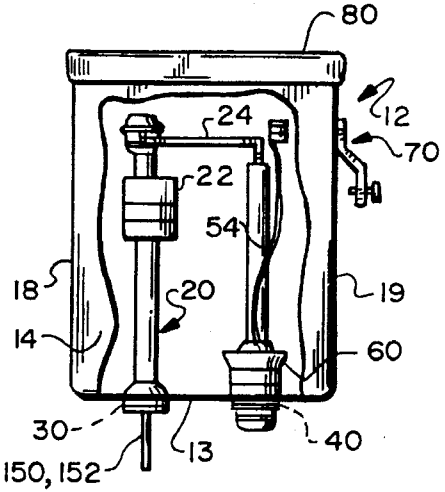
FIG. 4 is a partly cut away view of the secondary water reservoir shown in FIG. 3.
Figure 6:
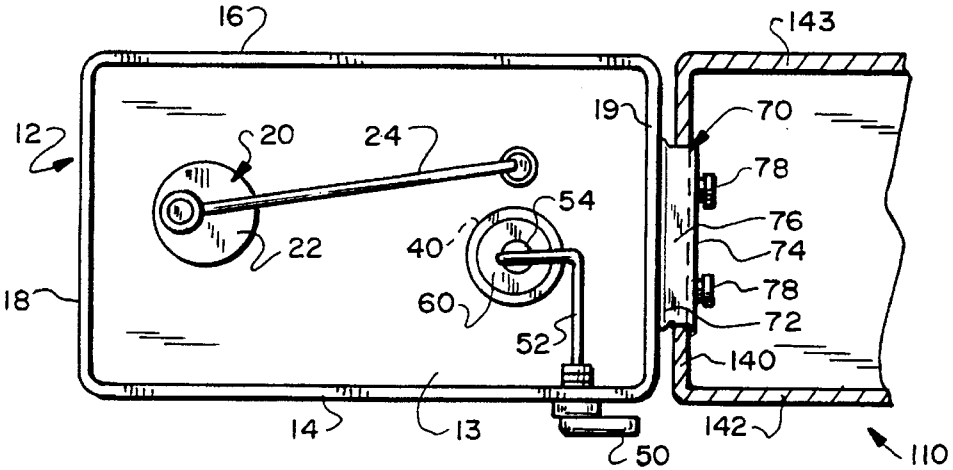
FIG. 6 is top sectional view taken along line A—A of the secondary water reservoir of FIG. 3.

Referring to FIGS. 1, 4 and 6, a first end 152 of a secondary inlet tube 150 is receivably connected through an inlet orifice 30 in the bottom plate 13 to a secondary inlet valve 20 positioned within the secondary water reservoir 12. The means for connecting inlet tube 150 to inlet valve 20 can be by any of a number of well known conventional methods. Referring to FIGS. 1 and 2, a second end 154 of inlet tube 150 is connected to any suitable water supply. In the preferred embodiment of the invention, second end 154 of inlet tube 150 may be coupled to the primary reservoir inlet tube 160 by conventional methods, i.e., installing a T-shaped fitting in tube 160 and coupling second end 154 of tube 150.

Secondary inlet valve 20 is controlled by a float 22 contained within said secondary water reservoir 12. In operation, when secondary water reservoir 12 is empty, float 22 drops to the bottom of said reservoir causing secondary inlet valve 20 to open, thereby introducing water from inlet tube 150 into reservoir 12. When secondary water reservoir 12 is full, float 22 rises to the top of the reservoir closing secondary inlet valve 20 thereby preventing the introduction of additional water into the reservoir 12.

Referring now to FIGS. 4 and 6, the bottom plate 13 also has a secondary discharge orifice 40 located therein. A secondary discharge valve 60 is seated on the discharge orifice 40 inside the secondary water reservoir 12 thereby sealing discharge orifice 40. Referring to FIG. 4, rigidly connected to secondary discharge valve 60 is one end of pull rod 54 which extends vertically toward the top of secondary water reservoir 12. Pull rod 54 may be a rod, chain or similar mechanism and may preferably be made from a suitable plastic or corrosion-resistant metal.

Preferably, secondary inlet valve 20, float 22 and secondary discharge valve 60 are conventional valve and float assemblies used commonly used for controlling the flow of water into and from a toilet reservoir.

Referring to FIG. 6, control arm 52 is preferably bent forming two ends which are generally at a 90 degree angle with each other. The other end of pull rod 54 is rigidly connected to a first end of control arm 52. The second end of control arm 52 is rigidly connected to secondary flush handle 50 which is rotatably attached to the exterior of the front wall 14 of said secondary water reservoir 12.

Figure 5:
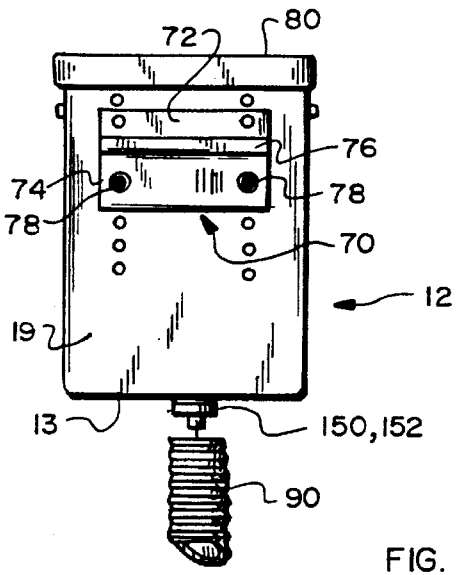
FIG. 5 is a side view of the secondary water reservoir shown in FIG. 3.

Referring to FIGS. 5 and 6, secondary water reservoir 12 is preferably mounted to the exterior of primary water reservoir 110 by mounting plate 70. In the preferred embodiment of the invention, mounting plate 70 has an upper vertical portion 72, a lower vertical portion 74 and an angular portion 76. The upper and lower vertical portions 72 and 74 may be generally parallel to each other and are rigidly connected to one another by the angular portion 76. Mounting plate 70 may be formed by conventional methods from any suitable material, such as heavy-duty plastic or corrosion-resistant metal, i.e., aluminum.

Mounting plate 70 is secured to side wall 19 of secondary water reservoir 12 forming a recess 79 between side wall 19 and lower vertical portion 74. The width of recess 79 is preferably slightly greater than the width of side wall 140 of the primary water reservoir 110. The mounting plate 70 can be attached to said side wall 19 by any of a number of conventional fastening means, such as a screw, a nut and bolt arrangement, or conventional welding methods.

Referring to FIGS. 1 and 6, primary water reservoir cover 130 can be removed to provide access to the interior of primary water reservoir 110. Side wall 140 of the primary water reservoir 110 is slidably received within recess 79 until angular portion 76 of the mounting plate 70 rests against the top of side wall 140. Clamping means 78 attached to said lower vertical portion 74 of said mounting plate 70, such as one or more wing nuts, may be applied to hold the side wall 19 of the secondary water reservoir 12 against side wall 140 of the primary water reservoir 110. Cover 130 may then be repositioned back over said primary water reservoir 110 and secondary reservoir cover 80 may be placed over secondary water reservoir 12 as illustrated in FIG. 1.

While we have described a preferred embodiment of the invention having the secondary water reservoir 12 mounted externally on the primary water reservoir 110, it is understood that secondary water reservoir 12 does not necessarily have to be secured to the primary water reservoir 110. Secondary water reservoir 12 may be mounted anywhere in the general proximity of toilet 10 and still function in the same manner as described herein. For instance, due to varying space limitations about the toilet 10, it may be deemed more advisable to attach secondary water reservoir 12 to a wall in the general vicinity of the toilet 10 rather than to the exterior of the primary water reservoir 110. This can be accomplished by attaching the mounting plate 70 to the wall by any of a number of conventional fastening methods, e.g., a screw or a nail.

Referring now to FIGS. 1, 2, 7 and 8, an external water feed member 170 is attached to rim 102 of toilet bowl 100. The water feed member 170 comprises a generally cylindrical body 190 which tapers down to a generally flat horizontal portion 196. The cylindrical body 190 has a bore 172 therethrough along a longitudinal axis. One end of the bore 172 is open forming an inlet orifice 171 and the other end is closed, preferably by threading a plug 198 into the bore 172 of said cylindrical body 190.

Extending in a generally downward direction from the horizontal portion 196 are two elongated legs 192 and 194, which are both generally parallel to said longitudinal axis. Leg 194 is located at the end of the horizontal portion 196 furthest from cylindrical body 190. Leg 192 extends downward from horizontal portion 196 to form a bowl recess 176 between legs 192 and 194 preferably having a width slightly greater than that of bowl rim 102 of toilet 10.

Water feed member 170 is mounted atop bowl rim 102 of conventional toilet 10 so that bowl rim 102 is slidably received within bowl recess 176, leg 194 extending into bowl 100, and the lower surface of said horizontal portion 196 sitting upon said bowl rim 102. Water feed member 170 can be secured to the bowl 100 by conventional fastening means 180, such as one or more set screws threadedly received within leg 192 as illustrated in FIG. 7.

Figure 7:
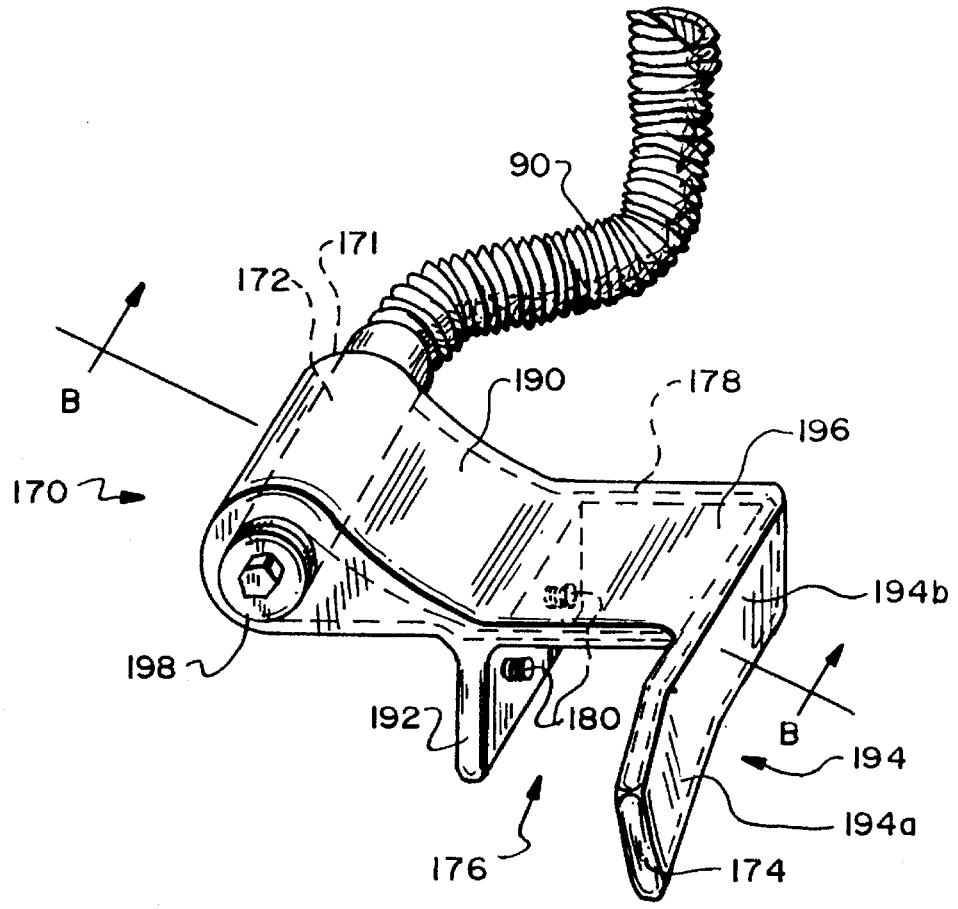
FIG. 7 is an enlarged perspective view of the water feed member and secondary discharge tube shown in FIGS. 1 and 2.
Figure 8:
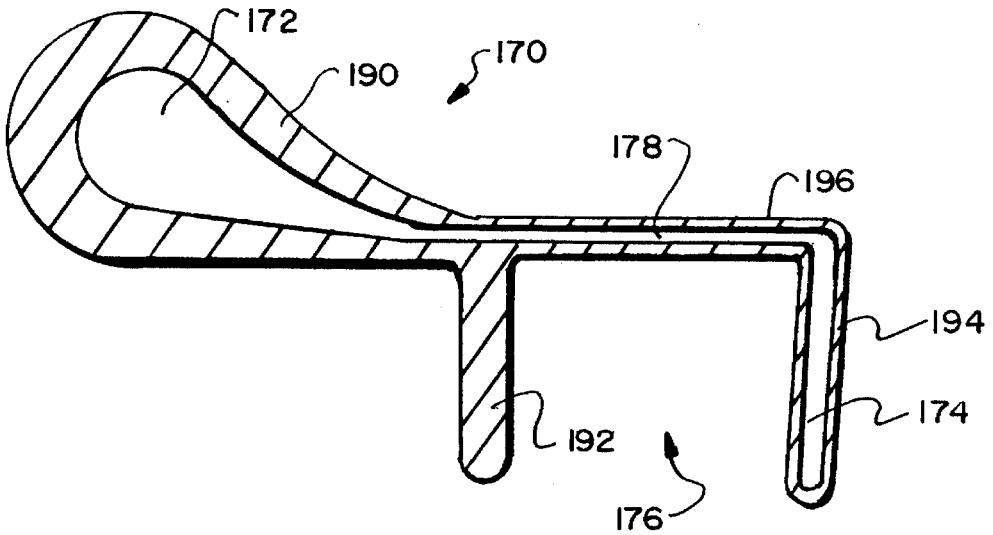
FIG. 8 is an elevation sectional view taken along line B—B of the water feed member shown in FIG. 7.

Referring to FIGS. 7 and 8, leg 194 has an outlet orifice 174 extending longitudinally throughout most of its length. An end portion 194*a* of leg 194 is preferably inclined in a slightly downwardly direction relative to leg portion 194*b* of leg 194 so that outlet orifice 174 is directed in a downwardly direction. Bore 172 is internally connected to outlet orifice 174 by an internal channel 178 formed within horizontal portion 196 and cylindrical body 190 to form a continuous passage through water feed member 170 from inlet orifice 171 to outlet orifice 174.

In a preferred embodiment of the present invention, the external water feed member 170 is made from a rigid plastic material that is capable of being molded when heated into the configuration described above. One method of forming the water feed member 170 may be through conventional injection molding techniques by forming top and bottom portions of the water feed member 170 which may be integrally joined to each other by welding or other conventional methods. The external water feed member 170 may be made from polyvinyl chloride (PVC), acrylonitrile-butadiene-styrene (ABS), polyethylene, or any other suitable material that lends itself to be moldable, easily cleanable and readily detachable from the toilet bowl rim 102.

Figure 3:
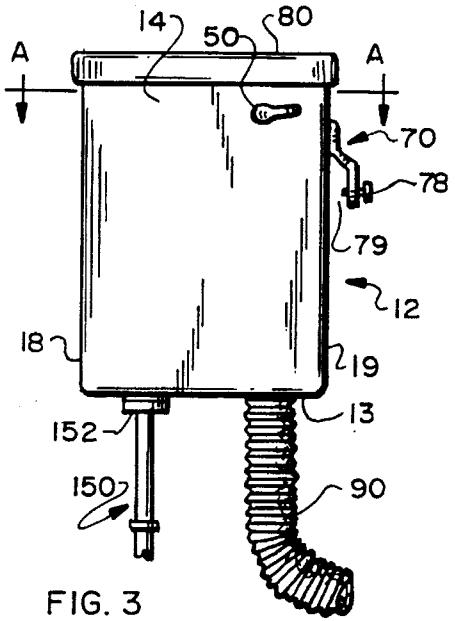
FIG. 3 is a frontal view of the secondary water reservoir as shown in FIGS. 1 and 2.

Referring to FIGS. 1 and 3, one end of a secondary discharge tube 90 is coupled to discharge orifice 40 of second water reservoir 12 by conventional methods well known in the art. The other end of discharge tube 90 is coupled to water feed member 170 at the inlet orifice 171 so as to not interfere with the continuous passage through water feed member 170 from inlet orifice 171 to outlet orifice 174. Conventional couplings well known in the art may be used to connect discharge tube 90 to inlet orifice 171, such as a threaded coupling.

Referring to FIG. 1, when it is desired to flush conventional toilet 10 in its normal manner, such as when a large quantity of solid waste is deposited in said bowl 100, primary flush handle 120 is simply pushed in a generally downward direction thereby discharging the first body of water contained in the primary water reservoir 110 into said bowl 100 and out of said drain 103.

Alternatively, when a lesser volume of water is required to flush waste from the bowl 100, such as where liquid waste is deposited in the bowl, secondary flush handle 50 is pushed in a generally downward direction causing control arm 52 to rotate about its axis in a clockwise direction. Such clockwise rotation of control arm 52 lifts push rod 54 in an upward direction thereby lifting secondary discharge valve 60 from atop secondary discharge orifice 40. As a result, the second body of water is discharged from second water reservoir 12 and flows through discharge tube 90 into inlet orifice 171, through internal channel 178 and out outlet orifice 174 of the water feed member 170. Upon exiting from outlet orifice 174, the second body of water is directed into the bowl 100 along its periphery and in a downwardly direction, thereby creating a swirling action and causing the waste material to be carried down the drain 103.

Once the secondary flush handle 50 is released and the water contained within the secondary water reservoir 12 is thoroughly discharged, secondary discharge valve 60 will return to its resting position atop secondary discharge orifice 40 thereby closing said orifice.

Following the flushing of secondary water reservoir 12, float 22 causes secondary inlet valve 20 to open, permitting fresh water to be introduced into secondary water reservoir 12. When secondary water reservoir 12 is full, the float 22 causes secondary inlet valve 20 to close and the apparatus is again ready for use.

Thus, there has been shown and described a novel and useful means whereby a conventional toilet 10 can be modified to conserve the volume of water consumed during each flushing process. While the foregoing discussion describes the preferred embodiment of the present invention, the invention may also be embodied in other specific forms without departing from the spirit or essential characteristics thereof. Accordingly, the present embodiment is to be considered in all respects as illustrative and not restrictive, the scope of the invention being indicated by the appended claims rather than by the foregoing description, and all changes which come within the meaning and range of equivalency of the claims are therefore intended to be embraced herein.

We claim:

1. A water conservation unit for a toilet having a primary water reservoir with a predetermined volume, a bowl with a rim defining a perimeter and a water supply, comprising:

(a) a secondary water reservoir having an input orifice and a discharge orifice, said secondary water reservoir having a volume less than the volume of said primary water reservoir and adapted to be mounted externally of said primary reservoir;

(b) input means for introducing and controlling the flow of water into the input orifice of said secondary water reservoir;

(c) a water feed member having an inlet orifice, an outlet orifice, and a continuous passage therethrough connecting said inlet and outlet orifices, said water feed member comprising a substantially flat portion intermediate said inlet and outlet orifices and a depending leg portion including said outlet orifice therein said water feed member adapted to be attached to said bowl rim in such a manner that said outlet orifice is contained within and directed along the perimeter of said bowl;

(d) means for coupling the discharge orifice of said secondary water reservoir to the inlet orifice of said water feed member; and (e) discharge means for opening and closing the discharge orifice of said secondary water reservoir.

2. The water conservation unit of claim 1, wherein said means for coupling said secondary water reservoir to said water feed member comprises a hollow tube.

3. The water conservation unit of claim 1, wherein the input means for introducing and controlling the flow of water into said secondary water reservoir comprises an input valve for opening and closing the input orifice in said secondary water reservoir.

4. The water conservation unit of claim 3, wherein the input means further comprises a float member disposed within said secondary water reservoir and attached to said input valve, said float member being responsive to the level of water contained within said secondary water reservoir, whereby said input valve is closed when the water in said secondary water reservoir is at a predetermined full level.

5. The water conservation unit of claim 3, wherein the input means further comprises a tube having a first and a second end, the first end being coupled to the input orifice of said secondary water reservoir and the second end being adapted to be coupled to said water supply of said toilet.

6. The water conservation unit of claim 1, wherein the discharge means for opening and closing the output orifice of said secondary water reservoir comprises:

(a) a flush handle pivotally mounted to said secondary water reservoir;

(b) a control arm having a first and second portion, said first portion being rigidly connected to said flush handle;

(c) a pull member having a first and a second end, the first end of the pull member being coupled to the second end of said control arm; and (d) a discharge valve seated upon the discharge orifice within said secondary water reservoir, said discharge valve having a first position closing said orifice and a second position opening said orifice, said second position being responsive to rotation of said flush handle.

7. The water conservation unit of claim 1, wherein the water feed member comprises:

(a) a generally cylindrical body including said inlet orifice and having an opening along an axially extending bore;

(b) a tapered portion connected to said cylindrical body;

(c) a longitudinally extending horizontal portion including and substantially flat portion and having two ends, the first end of said horizontal portion being connected to said tapered portion, said cylindrical body, said tapered portion and said horizontal portion defining a portion of said continuous passage, said passage being in communication with said bore;

(d) said leg portion defining a first leg extending downwardly from the second end of said horizontal portion, said first leg having an opening along a generally axially extending channel, wherein said axially extending channel is in communication with said passage; and (e) a second leg extending downwardly from said horizontal portion, said second leg being spaced a predetermined distance from said first leg, said first and second legs forming a recess therebetween.

8. The water conservation unit of claim 7, wherein a portion of the first leg of the water feed member is inclined in a downwardly direction relative to a second portion of said first leg.

9. The water conservation unit of claim 7, wherein the predetermined distance between said first and second legs is larger than the width of the rim of said toilet bowl.

10. The water conservation unit of claim 9, wherein said water feed member is adapted to be mounted upon said toilet bowl such that the rim of said bowl is adapted to be slidably received within said recess and said substantially flat portion rests upon said rim.

11. The water conservation unit of claim 1, further comprising fastening means for attaching the secondary water reservoir to said primary water reservoir.

12. The water conservation unit of claim 11, wherein said fastening means comprises a mounting plate having two upright portions and an angular portion, said angular portion connecting said upright portions, and wherein said secondary water reservoir is secured to one of the upright portions.

13. The water conservation unit of claim 1, wherein the input means is adapted to be fluidly connected to the water supply of said toilet.

14. A water saving toilet comprising:

(a) a primary water reservoir containing a first body of water having a predetermined volume;

(b) a bowl for depositing waste material, said bowl having a rim defining a perimeter;

(c) first input means for introducing water into said primary water reservoir;

(d) first discharge means for discharging said first body of water into said bowl;

(e) a secondary water reservoir containing a second body of water, wherein said second body of water has a volume less than the volume of said first body of water;

(f) mounting means for mounting said secondary water reservoir externally to said first water reservoir;

(g) second input means for introducing and controlling water into said secondary water reservoir;

(h) second discharge means for discharging said second body of water from said second water reservoir;

(i) a water feed member having an inlet orifice, an outlet orifice, and a continuous passage therethrough connecting said inlet and outlet orifices, said water feed member comprising a substantially flat portion intermediate said inlet and outlet orifices and a depending leg portion including said outlet orifice therein, said water feed member attached to said bowl wherein said outlet orifice is contained within and directed along the perimeter of said bowl and in a generally downwardly direction; and (j) connecting means for coupling said secondary water reservoir to the inlet orifice of said water feed member.

15. The water saving toilet of claim 14, wherein said connecting means for coupling said secondary water reservoir to said water feed member comprises a hollow tube.

16. The water saving toilet of claim 14, wherein said secondary water reservoir comprises an input orifice and a discharge orifice.

17. The water saving toilet of claim 14, wherein the second input means for introducing water into said secondary water reservoir comprises an input valve for opening and closing the input orifice in said secondary water reservoir.

18. The water saving toilet of claim 17, wherein a float member is disposed within said secondary water reservoir and attached to said input valve, said float member being responsive to the level of water contained within said secondary water reservoir, whereby said input valve is closed when the water in said secondary water reservoir is at a predetermined full level.

19. The water saving toilet of claim 14, wherein the second discharge means comprises:

(a) a secondary flush handle pivotally mounted to said secondary water reservoir;

(b) a secondary control arm having a first and second portion, said first portion being rigidly connected to said secondary flush handle;

(c) a secondary pull member having a first and a second end, the first end of said secondary pull member being coupled to the second end of said secondary control arm; and (d) a secondary discharge valve seated upon the second discharge orifice within said secondary water reservoir, said secondary discharge valve having a first position closing said orifice and a second position opening said orifice, said second position being responsive to rotation of said secondary flush handle.

20. The water saving toilet of claim 14, wherein the water feed member comprises:

(a) a generally cylindrical body including said inlet orifice and substantially having an opening along an axially extending bore;

(b) a tapered portion connected to said cylindrical body;

(c) a longitudinally extending horizontal portion including said substantially flat portion and having two ends, the first end of said horizontal portion being connected to said tapered portion, said cylindrical body, said tapered portion and said horizontal portion defining a portion of said continuous passage, said passage being in communication with said bore;

(d) said leg portion defining a first leg extending downwardly from the second end of said horizontal portion, said first leg having an opening along a generally axially extending channel, wherein said axially extending channel is in communication with said passage; and (e) a second leg extending downwardly from said horizontal portion, said second leg being spaced a predetermined distance from said first leg, said first and second legs forming a recess therebetween.

21. The water saving toilet of claim 20, wherein a first portion of the first leg of the water feed member is inclined in a downwardly direction relative to a second portion of said first leg.

22. The water saving toilet of claim 20, wherein the predetermined distance between said first and second legs is larger than the width of the rim of said toilet bowl.

23. The water saving toilet of claim 22, wherein said water feed member is mounted upon said toilet bowl such that the rim of said bowl is slidably received within said recess and said horizontal portion rests upon said rim.

24. The water saving toilet of claim 14, wherein said mounting means comprises a mounting plate having two upright portions and an angular portion, said angular portion connecting said upright portions, and wherein said secondary water reservoir is secured to one of the upright portions.

25. A method for conserving the amount of water consumed in flushing waste from a toilet having a primary water reservoir for holding a first body of water having a predetermined volume and a bowl with a rim defining a perimeter, comprising the steps of:

(a) externally mounting a secondary water reservoir from the primary water reservoir, wherein the secondary water reservoir holds a second body of water whose volume is less than the volume of the first body of water;

(b) fluidly connecting said secondary water reservoir to a water supply and filling said secondary water reservoir to a predetermined level;

(c) mounting a water feed member comprising a substantially flat portion and a depending leg portion including an outlet orifice on the rim of said toilet bowl and fluidly connecting said secondary water reservoir to said water feed member;

(d) actuating said secondary water reservoir and discharging the second body of water from said secondary water reservoir into said water feed member, said water feed member outlet orifice directing said discharged water into said toilet bowl along said perimeter and in a generally downwardly direction.

26. The method of claim 25, wherein the secondary water reservoir is mounted on the primary water reservoir.

* * * * *